US006532756B1

(12) United States Patent
Wang et al.

(10) Patent No.: US 6,532,756 B1
(45) Date of Patent: Mar. 18, 2003

(54) REFRIGERATOR WITH A FOLDABLE TABLE

(75) Inventors: Dongning Wang, Qingdao (CN); Zhiping Li, Qingdao (CN); Lingfei Xu, Qingdao (CN); Wei Zhang, Qingdao (CN)

(73) Assignees: Haier Group Corporation (CN); Qingdao Refrigerator Co., Ltd. (CN)

( * ) Notice: Subject to any disclaimer, the term of this patent is extended or adjusted under 35 U.S.C. 154(b) by 0 days.

(21) Appl. No.: 10/052,872

(22) Filed: Jan. 15, 2002

(30) Foreign Application Priority Data

Sep. 2, 2001 (CN) ..... 01127372 A

(51) Int. Cl.[7] ..... F25D 23/12; F25D 19/00
(52) U.S. Cl. ..... 62/258; 62/261; 312/401
(58) Field of Search ..... 62/258, 440, 457.1, 62/457.7, 449, 261; 312/140.1, 405.1, 408, 401

(56) References Cited

U.S. PATENT DOCUMENTS 2,093,856 A * 9/1937 Wales ..... 62/89
2,642,725 A * 6/1953 Greenburg et al. ..... 62/11

* cited by examiner

*Primary Examiner*—Denise L. Esquivel
*Assistant Examiner*—Melvin Jones
(74) *Attorney, Agent, or Firm*—LaRiviere, Grubman & Payne, LLP

(57) ABSTRACT

This invention relates to a refrigerator with a foldable table, wherein the table can be unfolded when it is needed and can be folded when it is not needed. So the product of the present invention has the functions of both a refrigerator and a table, and also can save some room space providing a more reasonable room layout.

12 Claims, 9 Drawing Sheets

REFRIGERATOR WITH A FOLDABLE TABLE

RELATED APPLICATIONS

This invention hereby makes reference to, and derives priority from Peoples Republic of China Patent Application No. 01127372.0, filed Sep. 2, 2001.

TECHNICAL FIELD

This invention relates to a refrigerator, more particularly to a combination of a refrigerator and a foldable table.

BACKGROUND OF THE INVENTION

Current refrigerators are generally of rectangular shape for foods freezing or preservation. A refrigerator occupies some space when it is placed in a kitchen or any other room. With the extensive application of refrigerators, they have also been widely used in apartments and domiciles that have relatively small room, where a regular refrigerator occupies a relative large space. Accordingly, the existing refrigerators make against the effective use of space.

DESCRIPTION OF THE PRESENT INVENTION

With the restriction of space, the present application proposes to combine a refrigerator with a furniture, particularly the combination of a refrigerator and a foldable desk, which not only save space, but also save cost as the users do not need to purchase refrigerator and desk respectively. The present application includes a refrigerator and a table arranged on body of the refrigerator, wherein, the table can be folded together with the side of refrigerator.

The table includes one or two table plates, which are fixed on one side or two sides of the refrigerator via hinges; the table plates fixed at the sides of refrigerator can be at the same level with or lower than the top of the refrigerator.

This invention can also be achieved by the following structure. The table includes at least two table plates, which are fixed on the refrigerator top through a sliding groove; the sliding groove is fixed on the refrigerator top; two fixing boards are fixed at both sides of the sliding groove; the table plates are fixed on the fixing boards and can move along the sliding groove; alternatively, there are two sliding grooves fixed on the refrigerator top in parallel and the table plates are arranged thereon that can move along the grooves. There are three table plates, wherein the two side plates can move to the ends of the sliding grooves and the third table plate is laid in the middle of the side plates.

This invention can also be realized by the following structure. The table includes table plate and table leg, wherein the table plate is fixed at one side or the back of the refrigerator via hinges; the table plate is at the same level with or lower than the refrigerator top; the table plate can be folded on the refrigerator top or one side of the refrigerator; and there are one or two table legs that can be folded in parallel with the table plate.

This invention combines table and refrigerator together. Furthermore, the table can be folded in parallel with the refrigerator. The table can be unfolded once is needed and folded when it is unnecessary. With functions of both refrigerator and table, this invention can not only save space but also make indoor layout more reasonable; in addition, it can save space during transportation and has the characteristic of low cost.

PREFERRED EMBODIMENTS OF THE PRESENT APPLICATION

With reference to FIGS. 1~4, the present invention includes a refrigerator and a table. The table has two table plates 4 fixed at the sides 2 of the refrigerator via hinges 3. Table plates 4 are at the same level with refrigerator top 1 and the table plates can be laid or folded in parallel with sides of the refrigerator.

Figure 1:
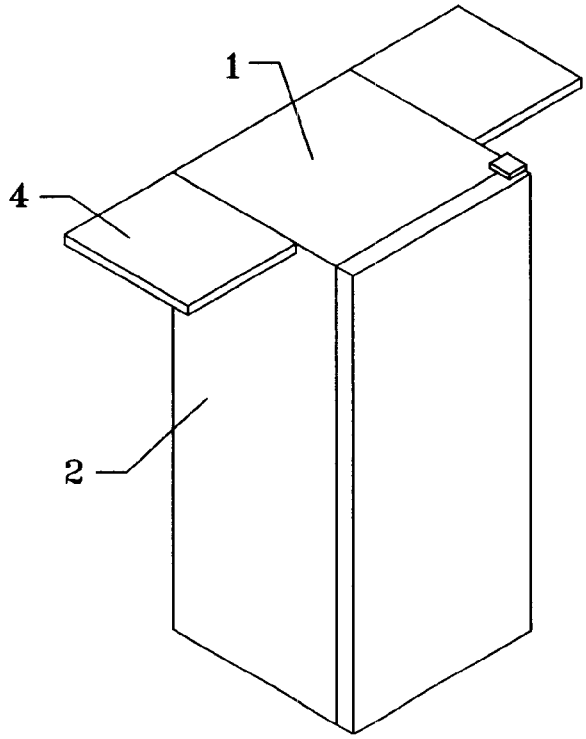
FIG. 1 shows the structure 1 of the first embodiment of the present application.
Figure 2:
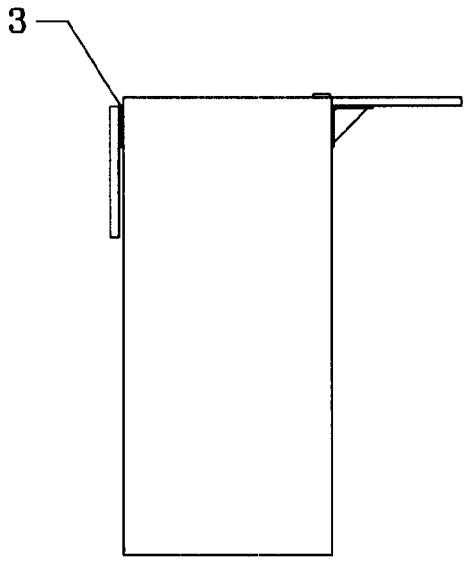
FIG. 2 shows the structure 2 of the first embodiment of the present application.
Figure 3:
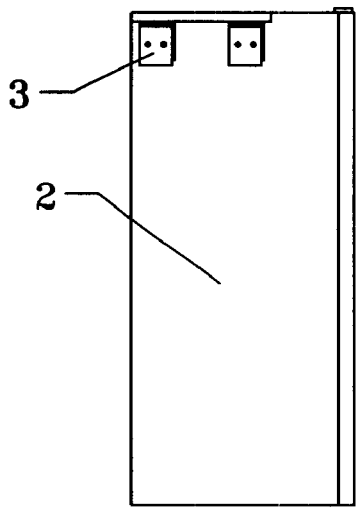
FIG. 3 is the side view of FIG. 1.
Figure 4:
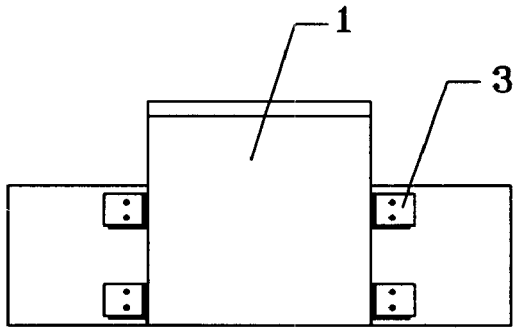
FIG. 4 is the bottom view of FIG. 1.
Figure 5:
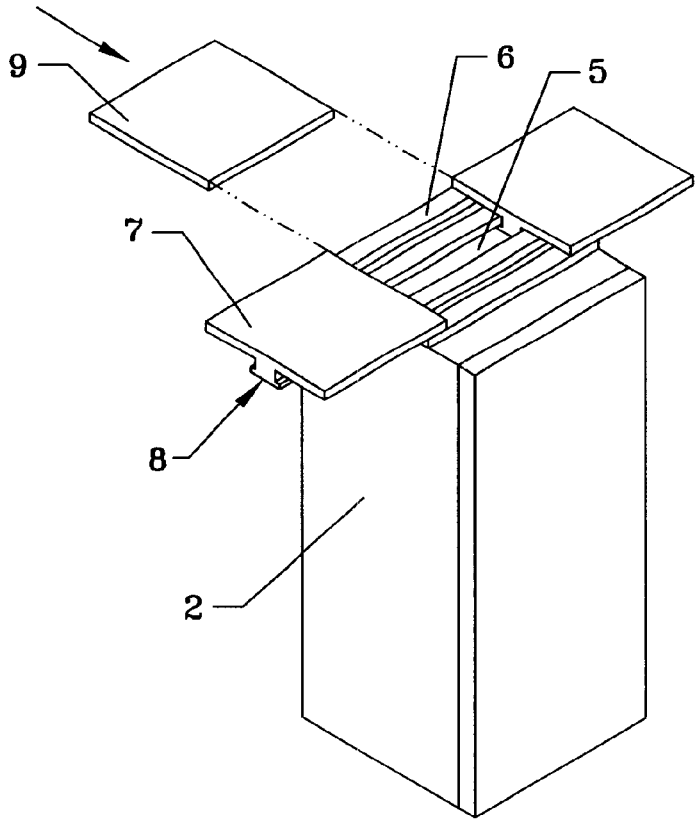
FIG. 5 shows the structure 1 of the second embodiment of the present application.
Figure 6:
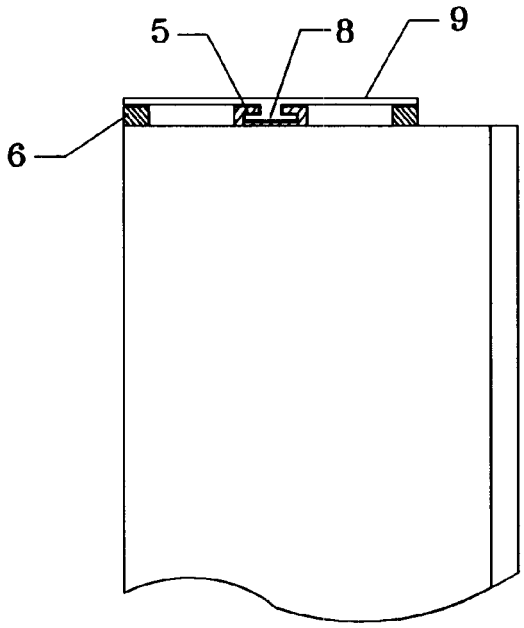
FIG. 6 is the side view of FIG. 5.

With reference to FIGS. 5~6, the present invention includes a refrigerator and a table that has three table plates. A sliding groove 5 is fixed on the refrigerator top and two fixing boards 6 are fixed along both sides of the sliding groove 5. Two table plates 7 are arranged on the fixing boards 6 and a sliding rail 8 is inserted into the sliding groove 5, so that the table plates can move along the sliding groove. When the table is folded, the two table plates in the sliding groove are on the refrigerator top while when the table plates slide to both ends of the sliding groove, a third table plate can just be laid between them to form a flat table top.

Figure 7:
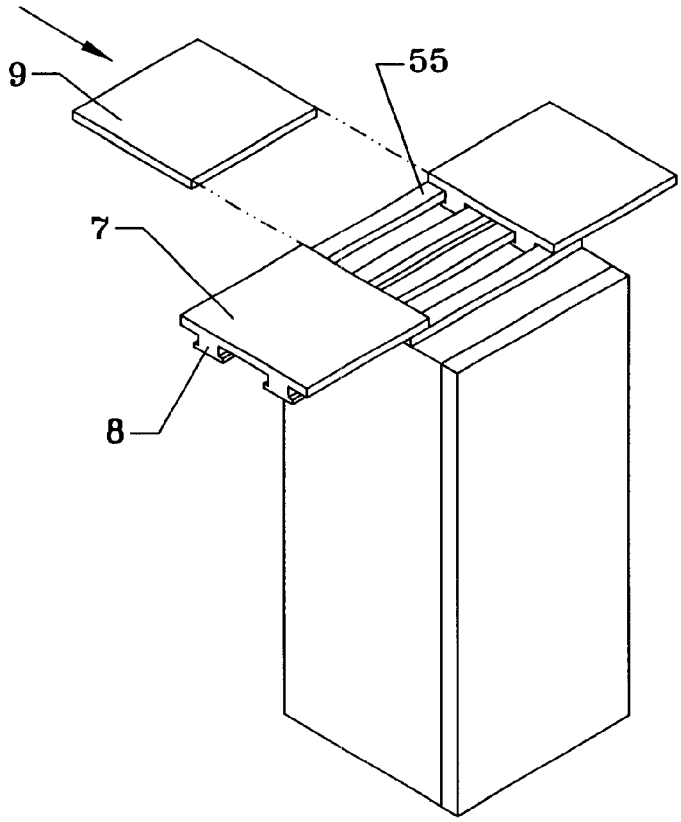
FIG. 7 shows the structure 2 of the second embodiment of the present application.
Figure 8:
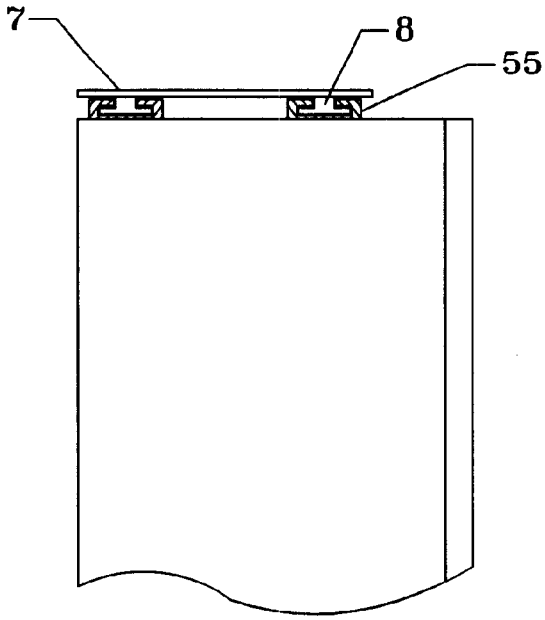
FIG. 8 is the side view of FIG. 7.

With reference to FIGS. 7~8, the present invention includes a refrigerator and a table that has three table plates. Two sliding grooves 55 are fixed on the refrigerator top in parallel. Two table plates 7 are arranged on the sliding grooves 55 and sliding rails 8 are inserted therein, so that the table plates can move along the sliding grooves. When the table is folded, two table plates 7 in the sliding grooves are on the refrigerator top while the table plates slide to both ends of the sliding grooves, a third table plate 9 can just be laid between them to form a flat table top.

Figure 9:
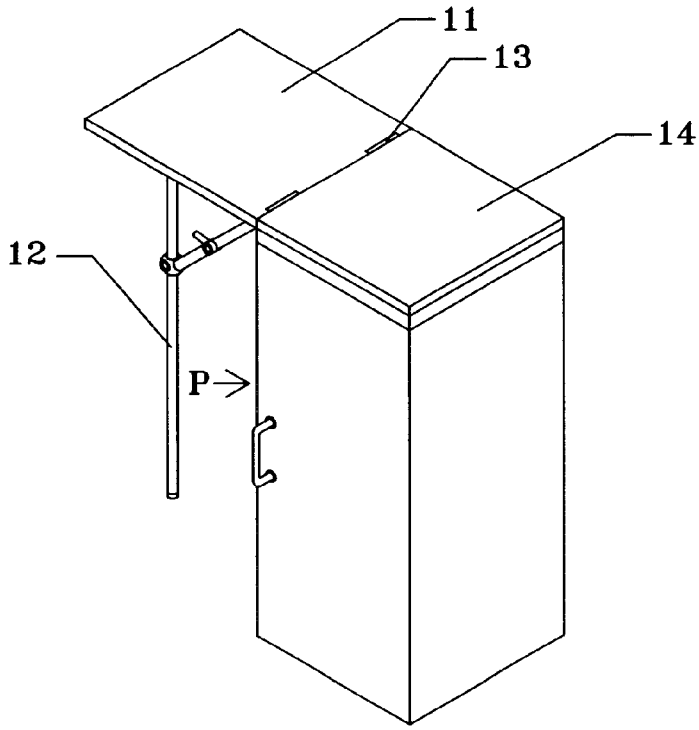
FIG. 9 shows the structure 1 of the third embodiment of the present application.

With reference to FIG. 9, the present invention includes a refrigerator and a table that has a table plate 11 and a table leg 12. The table plate 11 is fixed at one side of the refrigerator via hinge 13 and at the same level with refrigerator top 14. There is one table leg 12. The table plate 11 can be folded on the refrigerator top 14 and the table leg 12 can be folded in parallel with the table plate.

Figure 10:
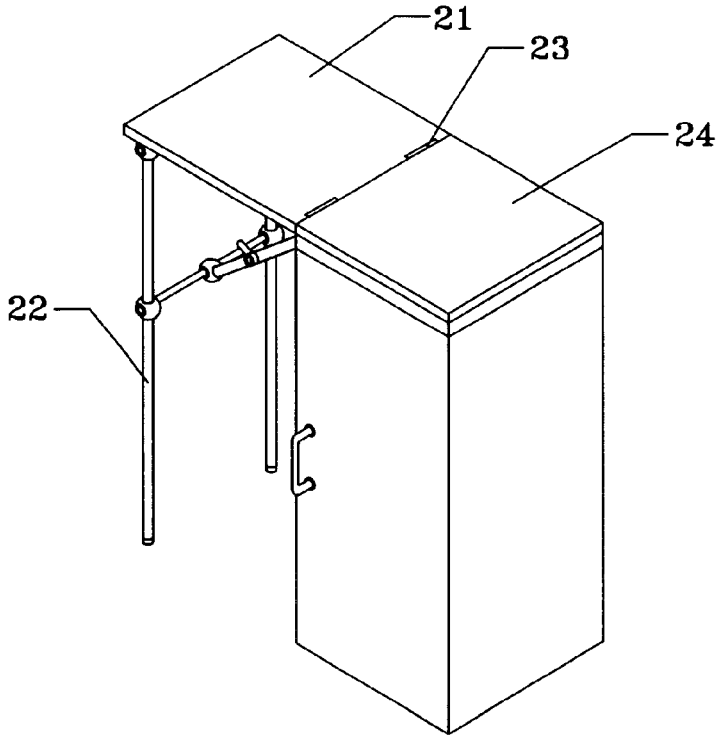
FIG. 10 shows the structure 2 of the third embodiment of the present application.

With reference to FIG. 10, the present invention includes a refrigerator and a table that has a table plate 21 and table legs 22. The table plate 21 is fixed at one side of the refrigerator via hinges 23 and at the same level with refrigerator top 24. There are two table legs 22. The table plate 21 can be folded on the refrigerator top 24 and the table legs 22 can be folded in parallel with the table plate.

Figure 11:
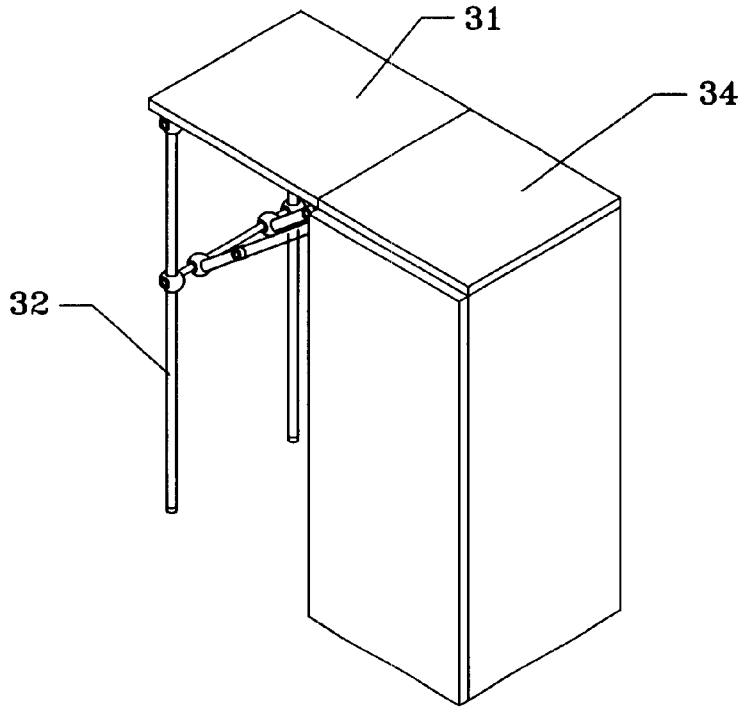
FIG. 11 shows the structure 3 of the third embodiment of the present application.
Figure 12:
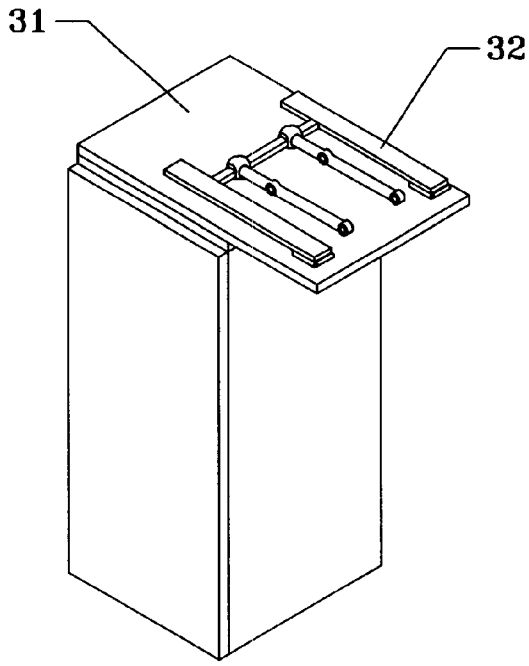
FIG. 12 shows the structure 4 of the third embodiment of the present application.

With reference to FIGS. 11 and 12, the present invention includes a refrigerator and a table that has a table plate 31 and table legs 32. The table plate 31 is fixed at one side of the refrigerator via hinges and at the same level with refrigerator top 34. There are two table legs 32. The table plate 31 can be folded on the refrigerator top 34 and the table legs 32 can be folded in parallel with the table plate.

Figure 13:
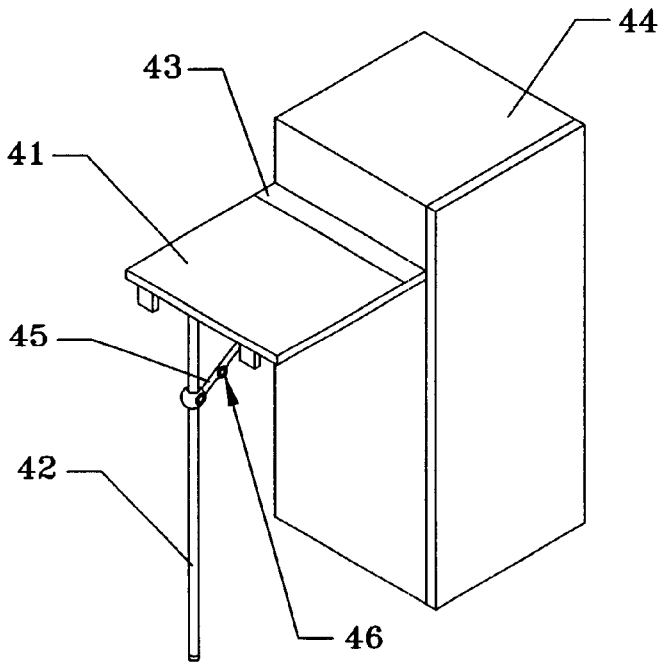
FIG. 13 shows the structure 5 of the third embodiment of the present application.
Figure 14:
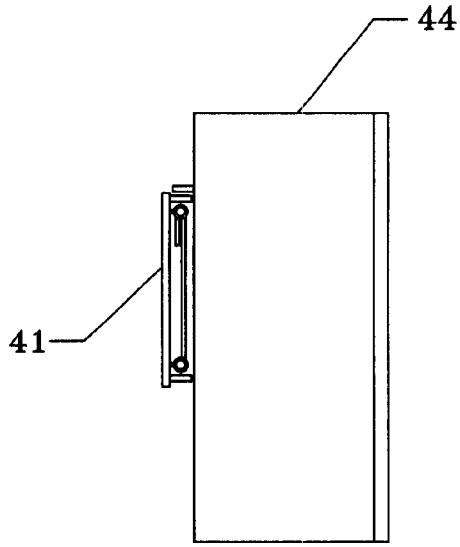
FIG. 14 shows the structure 6 of the third embodiment of the present application.

With reference to FIGS. 13 and 14, the present invention includes a refrigerator and a table that has a table plate 41 and a table leg 42. The table plate 41 is fixed at one side of the refrigerator via batten 43 and hinges and lower than the refrigerator top 44. There is one table leg 42. A tail arm 45 hinged by a hinge 46 is set between the table leg and table plate. The table plate 41 can be folded standing by the side of refrigerator and the table leg 42 can be folded between the side of refrigerator and the table plate.

Figure 15:
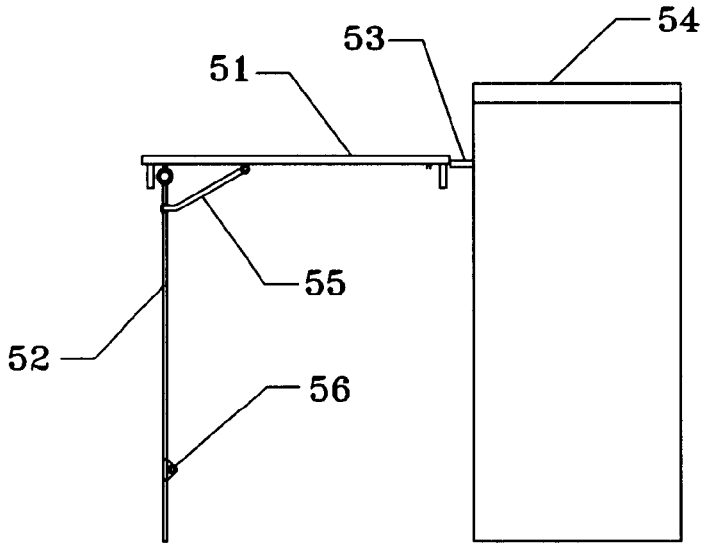
FIG. 15 shows the structure 7 of the third embodiment of the present application.
Figure 16:
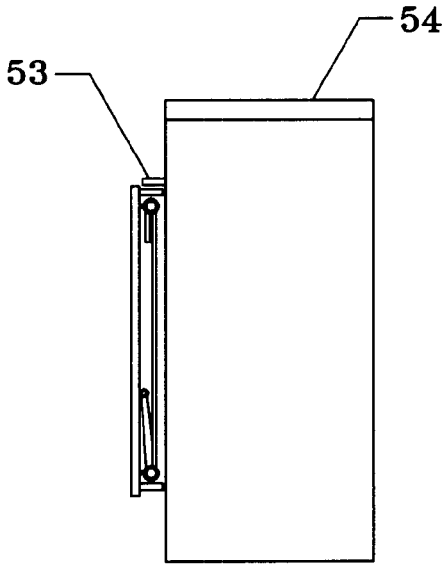
FIG. 16 shows the structure 8 of the third embodiment of the present application.
Figure 17:
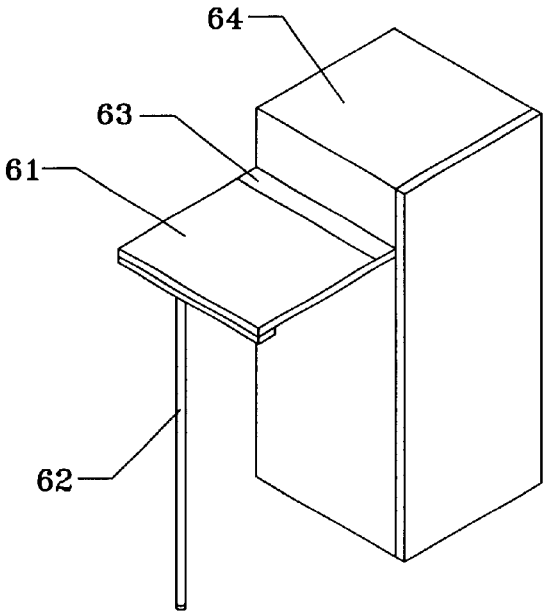
FIG. 17 shows the structure 9 of the third embodiment of the present application.
Figure 18:
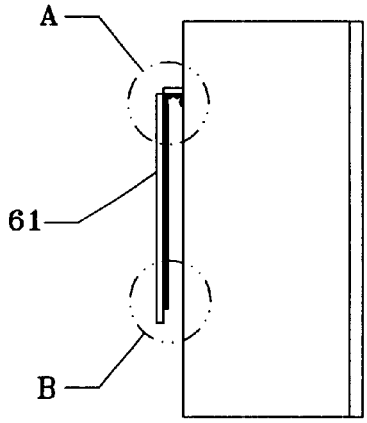
FIG. 18 shows the structure 10 of the third embodiment of the present application.
Figure 19:
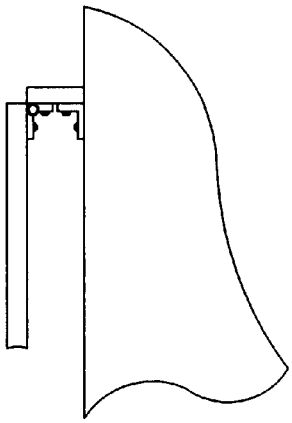
FIG. 19 is the enlarged view of part A of FIG. 18.
Figure 20:
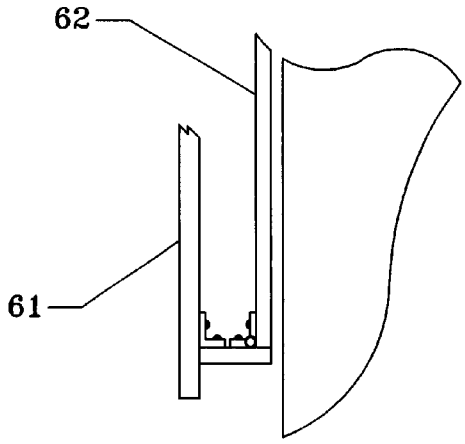
FIG. 20 is the enlarged view of part B of FIG. 18.

With reference to FIGS. 15 and 16, the present invention includes a refrigerator and a table that has a table plate 51 and a table leg 52. The table plate 51 is fixed at one side of the refrigerator via batten 53 and hinges and lower than the refrigerator top 54. There is one table leg 52 whose lower part has a hinge 56. A table leg 52 is equipped with hinge 56 at the lower part of it. A tail arm 55 connected by hinges is set between the table leg and table plate. By this way, the table plate 51 can be folded standing by the side of refrigerator and table leg 52 can be folded between the side of refrigerator and the table plate with the support of hinge 56 and the tail arm 55.

With reference to FIGS. 17~20, the present invention includes a refrigerator and a table that has a table plate 61 and a table leg 62. The table plate 61 is fixed at one side of the refrigerator via batten 63 and hinge and lower than the refrigerator top 64. There is a table leg 62 hinged with the table plate. The table plate 61 can be folded standing by the side of refrigerator and table leg 62 can be folded between the side of refrigerator and the table plate.

Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element, or component, in the present disclosure is intended to be dedicated to the public regardless of whether the element, or component, is explicitly recited in the claims. No claim element herein is to be construed under the provisions of 35 U.S.C. 112, sixth paragraph, unless the element is expressly recited using the phrase "means for."

What is claimed:

1. A refrigerator comprising:

a body having a top, a back, and at least one side; and a foldable table positioned on the body of the refrigerator, wherein the table has at least one table plate fixed by hinges on at least one side of the refrigerator body.

2. The refrigerator with a foldable table as recited in claim 1, wherein the table plate fixed at the side of the refrigerator body is at the same level with or lower than the top of the refrigerator.

3. The refrigerator with a foldable table as recited in claim 1, wherein the table has at least two table plates fixed on the top of the refrigerator by sliding grooves.

4. The refrigerator with a foldable table as recited in claim 3, wherein the sliding grooves are fixed on the top of the refrigerator, a pair of fixing boards are respectively fixed along both sides of the sliding grooves, and the table plates are arranged on the fixing boards and slide along the sliding grooves.

5. The refrigerator with a foldable table as recited in claim 3, including two sliding grooves fixed on the top of the refrigerator, and the table plates are arranged on the sliding grooves and movable along the sliding grooves.

6. The refrigerator with a foldable table as recited in claim 4, including three table plates, two of the table plates being able to move to both ends of the sliding grooves so that the third table plate can be laid between the first two table plates.

7. The refrigerator with a foldable table as recited in claim 5, including three table plates, two of the table plates being able to move to both ends of the sliding grooves so that the third table plate can be laid between the first two table plates.

8. The refrigerator with a foldable table as recited in claim 1, wherein the table includes at least one table plate and at least one leg, and the table plate is fixed at one side or the back of the refrigerator by hinges.

9. The refrigerator with a foldable table as recited in claim 8, wherein the table plate is at the same level with or lower than the top of the refrigerator.

10. The refrigerator with a foldable table as recited in claim 9, wherein the table plates can be folded on the top of the refrigerator or at one side of the refrigerator.

11. The refrigerator with a foldable table as recited in claim 9 wherein the table legs can be folded in parallel with the table plate.

12. The refrigerator with a foldable table as recited in claim 10 wherein the table legs can be folded in parallel with the table plate.

* * * * *